US009668593B2

(12) United States Patent
Cayce et al.

(10) Patent No.: US 9,668,593 B2
(45) Date of Patent: Jun. 6, 2017

(54) MODULAR DISPLAY TOWER

(71) Applicant: HALLMARK CARDS, INCORPORATED, Kansas City, MO (US)

(72) Inventors: Craig William Cayce, Kansas City, MO (US); Brian Lee Wegstein, Washburn, IL (US); Shaun P. Arness, Shawnee, KS (US)

(73) Assignee: Hallmark Cards, Incorporated, Kansas City, MO (US)

( * ) Notice: Subject to any disclaimer, the term of this patent is extended or adjusted under 35 U.S.C. 154(b) by 0 days.

(21) Appl. No.: 14/755,367

(22) Filed: Jun. 30, 2015

(65) Prior Publication Data

US 2015/0366374 A1 Dec. 24, 2015

Related U.S. Application Data

(63) Continuation-in-part of application No. 14/310,595, filed on Jun. 20, 2014, now Pat. No. 9,451,838.

(51) Int. Cl.
*A47F 5/10* (2006.01)
*A47F 5/05* (2006.01)
(Continued)

(52) U.S. Cl.
CPC ..... *A47F 5/05* (2013.01); *A47F 5/0823* (2013.01); *A47F 5/10* (2013.01); *A47F 7/141* (2013.01); *A47F 7/146* (2013.01)

(58) Field of Classification Search
CPC ..... A47F 5/04; A47F 5/05; A47F 5/06; A47F 5/0823; A47F 7/141; A47F 7/146
(Continued)

(56) References Cited

U.S. PATENT DOCUMENTS 2,354,485 A 7/1944 Slaughter
2,532,600 A 12/1950 Broersma
(Continued)

FOREIGN PATENT DOCUMENTS

EP 1057434 A1 * 12/2000 ..... A47F 5/0018
GB 1482997 A 8/1977
WO 2014116720 A1 7/2014

OTHER PUBLICATIONS

Non-Final Office Action dated Sep. 17, 2015 in U.S. Appl. No. 14/310,595, 13 pages.
(Continued)

*Primary Examiner* — Joshua Rodden
(74) *Attorney, Agent, or Firm* — Shook, Hardy & Bacon L.L.P.

(57) ABSTRACT

A snap-in card top riser is provided having a riser and a display module. The riser has a hook profile that is adapted to be received into a channel on the display module so that the riser is secured to the display module in a manner that restricts removal of the riser from the display module. The channel has one or more tabs that are configured to cause the hook profile to compress while the tabs are engaging with the hook profile. A modular display tower is also provided that includes a base and one or more vertical display portions that are configurable to display different types of cards, items, and merchandise. The vertical display portions may interchangeably include curved display modules that receive one or more risers, or flat display portions, and the vertical display portions may be joined at respective edges with a bridge coupling.

15 Claims, 9 Drawing Sheets

(51) Int. Cl.
*A47F 5/08* (2006.01)
*A47F 7/14* (2006.01)

(58) Field of Classification Search
USPC ... 211/50, 94.01, 94.02, 188, 189, 196, 201, 211/205
See application file for complete search history.

(56) References Cited

U.S. PATENT DOCUMENTS 2,710,473 A 6/1955 Kress et al.
2,752,215 A * 6/1956 Peiss ..... A47B 87/008 312/111
3,195,736 A * 7/1965 Bomar, Jr. ..... A47F 5/05 211/163
3,507,064 A 4/1970 Hammero
3,695,455 A * 10/1972 Larson ..... A47F 5/02 211/78
3,739,919 A * 6/1973 Hochman ..... A47F 5/0815 211/194
4,003,470 A * 1/1977 Lagorio ..... G09F 5/00 211/50
4,126,366 A * 11/1978 Handler ..... B25H 3/00 108/152
4,182,087 A 1/1980 Schall et al.
4,673,090 A * 6/1987 Crosslen ..... A47F 5/02 16/355
4,949,849 A 8/1990 Hardy
5,054,624 A * 10/1991 Camp ..... A47F 7/02 211/163
5,078,283 A * 1/1992 Wilson ..... A47F 5/101 160/135
D338,355 S * 8/1993 Wells ..... D6/630
5,378,056 A * 1/1995 Wilson ..... A47F 5/108 211/189
5,398,468 A * 3/1995 Erickson ..... A47F 5/0846 211/94.01
5,485,934 A * 1/1996 Holztrager ..... A47F 5/0846 211/126.2
5,653,348 A * 8/1997 MacDonald ..... A47F 5/0807 211/87.01
D393,959 S * 5/1998 Geier ..... D6/678
D393,960 S * 5/1998 Geier ..... D6/678
6,302,285 B1 * 10/2001 Fulle ..... A47F 5/04 211/131.1
6,422,403 B1 7/2002 Woolnough et al.
6,439,399 B1 8/2002 Wegstein et al.
6,789,686 B2 * 9/2004 Bennett ..... A47B 81/068 211/189
D500,418 S * 1/2005 Levin ..... D6/680.2
7,093,726 B1 * 8/2006 Holztrager ..... A47F 5/0846 211/153
7,987,999 B2 8/2011 Weigand et al.
8,959,871 B2 2/2015 Parenti et al.
2006/0081548 A1 * 4/2006 Babbino ..... A47F 5/02 211/85.1
2006/0186063 A1 * 8/2006 Campbell ..... A47F 5/02 211/55
2010/0163501 A1 7/2010 Berry et al.
2011/0062094 A1 * 3/2011 Levine ..... A47F 5/02 211/58

OTHER PUBLICATIONS

Final Office Action dated Jan. 26, 2016 in U.S. Appl. No. 14/310,595, 14 pages.
Non-Final Office Action dated May 9, 2016 in U.S. Appl. No. 14/310,595, 11 pages.
Canadian Office Action dated Mar. 8, 2016 in Canadian Patent Application No. 2,876,610, 3 pages.

* cited by examiner

MODULAR DISPLAY TOWER

CROSS-REFERENCE TO RELATED APPLICATIONS

This Nonprovisional patent application is a continuation-in-part of and claims priority to U.S. Nonprovisional application Ser. No. 14/310,595, titled "Snap-In Card Top Riser," which was filed on Jun. 20, 2014, the contents of which is incorporated in this application by reference in its entirety.

STATEMENT REGARDING FEDERALLY SPONSORED RESEARCH OR DEVELOPMENT

Not applicable.

TECHNICAL FIELD

The present invention relates generally to merchandising displays.

BACKGROUND

Greeting cards are typically displayed on different types of shelves or displays. Traditionally, stores have metal frames or "fixtures" onto which opaque molded plastic sections are mounted. Clear plastic shelves may then be coupled to the display modules to provide the rows upon which the greeting cards are to be placed for display to consumers. Oftentimes, the shelves are not only difficult to mount, but are also difficult to remove. Further, the shelves and the metal frames are expensive to manufacture because of the thickness of the materials used in their manufacture. This is also true for rotating or free standing merchandise displays which are often material intensive to construct and limited in their use due to the fixed nature of their construction.

SUMMARY

This summary is provided to introduce a selection of concepts in a simplified form that are further described below in the Detailed Description section. This summary is not intended to identify key features or essential features of the claimed subject matter, nor is it intended to be used as an aid in determining the scope of the claimed subject matter. The scope of the invention is defined by the claims.

Embodiments of the present invention are directed to a snap-in card top riser having a riser with a hook profile, and a display module having a channel that is configured to receive the riser. The channel has one or more tabs that make contact with the hook profile as the riser is engaging with the channel. In one instance, the hook profile compresses as it is engaging with the tabs, and returns to its original position or shape once it is substantially received into the channel. Once substantially received into the channel, the riser is locked into place and remains in a relatively consistent position relative to the display module until removed from the display module. In some embodiments, multiple risers are utilized in a single display module, such as being adjacent to one another, and as such, the display module would also have multiple channels, such as the same quantity of channels as risers. This allows for a greater quantity of greeting cards or other items to be stored in the card top riser.

Further embodiments of the invention are directed to a modular display tower that is customizable and that can be used for displaying cards, merchandise, and/or other items ("display items"). The tower includes a base and one or more assembled sections which are interchangeable to provide different presentation arrangements of the display items. In one embodiment, the tower includes one or more vertical display portions, which may be panels or vac-formed panels, extending from a base, the vertical display portions coupled together, each of the vertical display portions flat or curved and configured with hooks or display modules for holding corresponding display items. In another embodiment, each of the vertical display portions includes first and second side edges having mateable coupling components that allow the vertical display portions to be joined at their respective side edges. In such an embodiment, the edges may be joined by a locking extrusion such as a bridge coupling which can be releasably secured to a first side edge of a first vertical display portion and a second side edge of a second adjacent vertical display portion, to link the vertical display portions together and provide segmented display areas around the circumference of the tower. Each of the vertical display portions of the modular tower may be flat, curved, or a combination of flat and curved. In some embodiments, the display modules include an outer covering that at least partially covers a curved riser positioned in a channel of the display module. This assembly of the display tower provides a simplified, customizable, and less material intensive construction with enhanced versatility.

BRIEF DESCRIPTION OF THE SEVERAL VIEWS OF THE DRAWINGS

The present invention is explained in more detail with reference to the embodiment illustrated in the attached drawing figures, in which like reference numerals denote like elements, in which FIGS. 1-18 illustrate but one possible embodiment of the present invention, and in which:

FIG. 1 is a front perspective view of a snap-in card top riser, in accordance with an embodiment of the present invention;

FIG. 2 is an enlarged fragmentary view of a portion of the snap-in card top riser of FIG. 1, with a lowermost riser in an exploded position, in accordance with an embodiment of the present invention;

FIG. 3 is a front right perspective view of at least a portion of a snap-in card top riser, in accordance with an embodiment of the present invention;

FIG. 4 is a rear perspective view of the snap-in card top riser of FIG. 2, in accordance with an embodiment of the present invention;

FIG. 5 is a cross sectional view of the snap-in card top riser of FIG. 1 taken along the line 5-5, in accordance with an embodiment of the present invention;

FIG. 6 is an enlarged fragmentary view of the snap-in card top riser of FIG. 5 taken in the area 6, in accordance with an embodiment of the present invention;

FIG. 7 is a perspective view of a first exemplary modular display tower, in accordance with an embodiment of the present invention;

FIG. 8 is a perspective view of a second exemplary modular display tower, in accordance with an embodiment of the present invention;

FIG. 9 is a perspective view of three vertical display portions ready to be assembled for use with a modular display tower, in accordance with an embodiment of the present invention;

FIG. 10 is a perspective view of an exemplary vertical display portion, in accordance with an embodiment of the present invention;

FIG. 11 is a top plan view of the vertical display portion of FIG. 10;

FIG. 12 is a side elevation cross-sectional view of a riser for use in a modular tower, in accordance with an embodiment of the present invention;

FIG. 13 is top right perspective view of the riser of FIG. 12;

FIG. 14 is a rear elevation view of the riser of FIG. 13;

FIG. 15 is a bottom plan view of the riser of FIG. 13;

FIG. 17 is a top plan view of two vertical display portions positioned adjacent one another to be joined together with a bridge coupling, in accordance with an embodiment of the present invention; and FIG. 18 is an enlarged, fragmentary, top plan view of the two vertical display portions joined together with the bridge coupling component, in accordance with an embodiment of the present invention.

DETAILED DESCRIPTION

Figure 1:
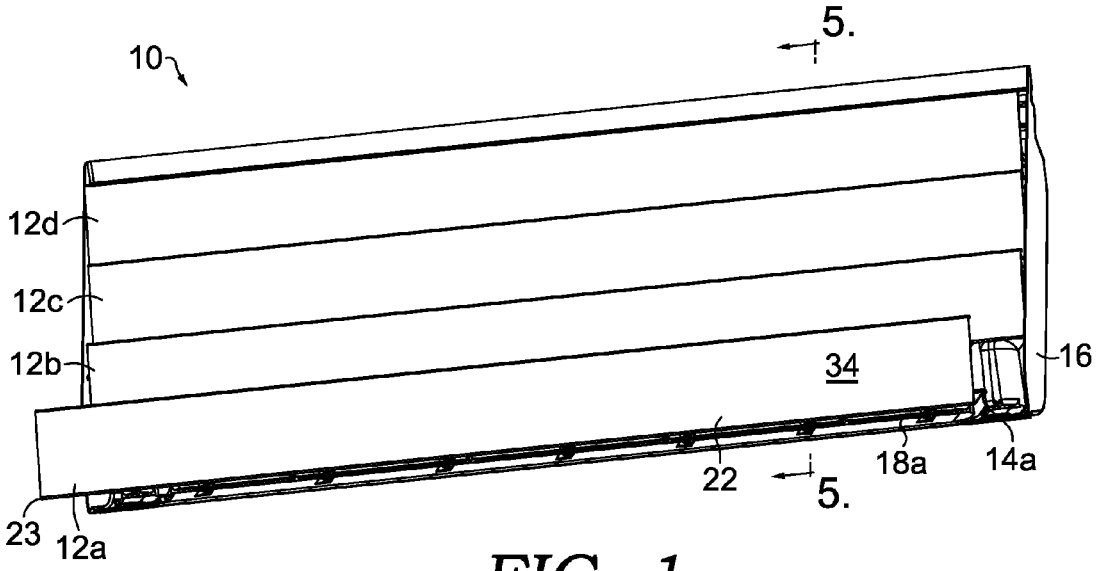

As mentioned, a snap-in card top riser may be used, for instance, in a commercial setting, such as a retail store, to hold greeting cards that are for sale. Aspects provided herein provide for card display modules that are more cost efficient to manufacture, in part because of the reduction of material used in comparison to traditional card display modules. For instance, the retaining risers and the display modules, as further described herein, may be thinner than traditional risers and card display modules. In one embodiment, the display module is 30% thinner and the risers are 40% thinner than traditional card display modules.

In one aspect, a snap-in card top riser is provided and comprises a riser having a hook profile, and a display module having a channel that is adapted to receive the hook profile to secure the riser to the display module. The channel has one or more tabs that are configured to cause the hook profile to compress while the one or more tabs are engaging with the hook profile, and the hook profile returns to an uncompressed position when the hook profile is substantially or fully received into the channel.

In a second aspect, a snap-in card top riser is provided and comprises a riser having an upper panel and a lower panel, the lower panel extending from a first edge of the upper panel, the lower panel having a first edge from which a hook profile extends. The snap-in card top riser also comprises a display module having at least an upper section, a middle section, and a channel that is formed at an intersection of the upper section and the middle section. The channel has one or more tabs and is configured to receive the hook profile. The hook profile is configured to compress when engaging with the one or more tabs of the channel, and the hook profile returns to an original position when substantially or fully engaged with the channel.

In a third aspect, a snap-in card top riser is provided and comprises a riser having a hook profile, and a display module having a channel that is adapted to receive the hook profile. The channel has one or more tabs that are configured to compress when the hook profile is engaging with the one or more tabs. The one or more tabs return to an uncompressed position when the hook profile is received into the channel.

In a fourth aspect, a display tower is provided and comprises a base and one or more vertical display portions. In a fifth aspect, a display tower is provided and comprises a base and one or more vertical display portions extending from the base and coupled together, each of the vertical display portions having one or more removable display modules. In a sixth aspect, a modular display tower is provided and comprises a base and two or more vertical display portions extending from the base, the two or more vertical display portions removably coupled together, each of the vertical display portions having first and second side edges, and each of the vertical display portions curved or flat between the respective first and second side edges.

Referring now to the drawings in more detail, wherein like reference characters designate like parts throughout the different views, and initially to FIG. 1, a front view of a snap-in card top riser 10 is depicted, in accordance with an embodiment of the present invention. The snap-in card top riser 10 of FIG. 1 includes multiple risers, shown here as risers 12*a*, 12*b*, 12*c*, and 12*d*. While four risers are illustrated in the embodiment of FIG. 1, it is contemplated that any quantity of risers may be utilized. The quantity of risers utilized may, for instance, be determined by how tall the card display module is to stand and/or how many greeting cards the card top riser is to hold. As will be shown more clearly in other figures herein, each riser may include a hook profile. Riser 12*a*, also referred to herein as a first riser, has a hook profile 14*a*, also referred to herein as a first hook profile. The card top riser may also include a second riser, such as riser 12*b*, having a second hook profile, etc. The first and second risers may correspond to first and second channels into which the risers are received.

Figure 3:
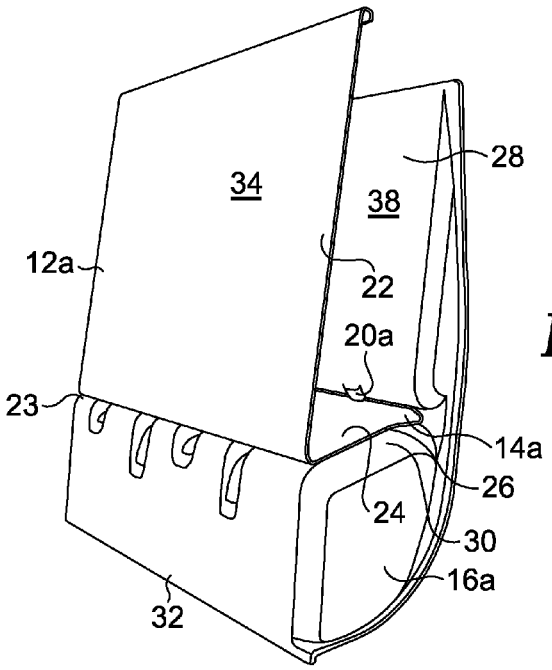
Figure 4:
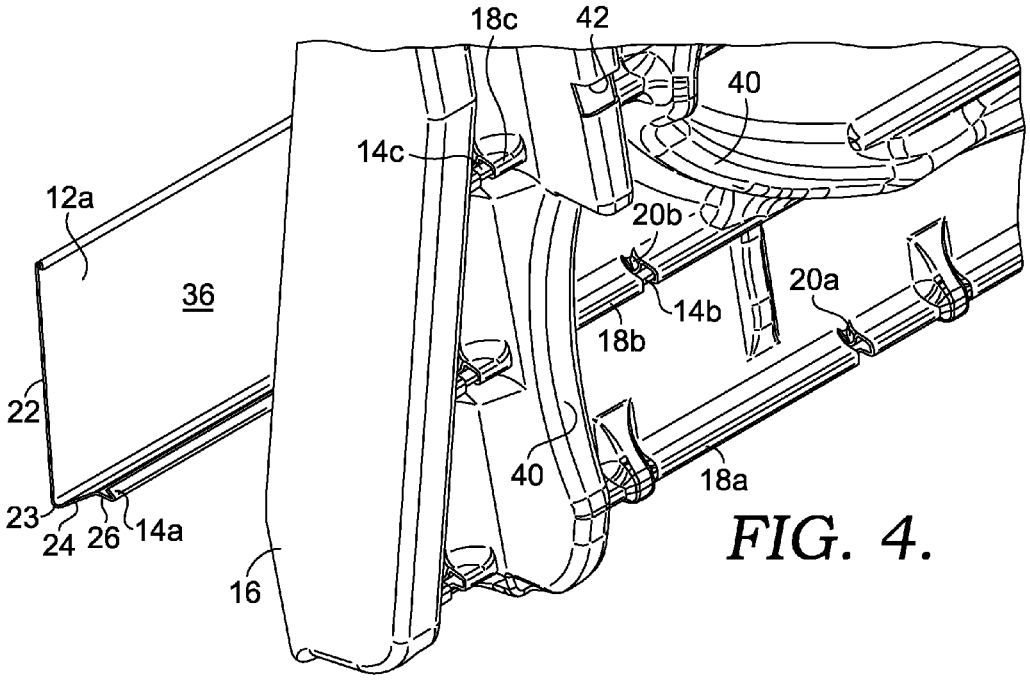

In one embodiment, each riser (items 12*a*-12*d*) comprises an upper panel 22 and a lower panel 24, the lower panel 24 extending from the upper panel 22. The upper panel 22 has a front surface 34 and a back surface 36 (shown in FIG. 4). The hook profile may extend from a first edge 23 of the lower panel, or at an edge of the lower panel farthest from the upper panel. The lower panel and the first edge of the lower panel are illustrated in FIGS. 3 and 4 herein. The hook profile, such as hook profile 14*a* shown in FIG. 1, is configured to engage with or be received into a portion of a display module 16. Although not specifically numbered in the figures, each riser has similar parts, including an upper panel having a first edge, and a lower panel also having a first edge.

The display module 16 includes a channel 18*a*, which can be seen in FIG. 1. The channel 18*a* runs laterally across the display module 16 and is configured to receive the hook profile 14*a* of the riser 12*a*. Additional channels 18*b*, 18*c*, and 18*d* are parallel to channel 18*a* and are visible in FIG. 5. In one embodiment, the quantity of risers corresponds to the quantity of channels, as each riser is received into a channel. The channels, such as the channel 18*a*, have grooves formed therein that are trimmed to create tabs that lock the risers into place. As such, each channel may comprise one or more tabs, the tabs being spaced apart laterally along the channel. In one instance, the tabs are equidistant from one another. In the illustrated embodiment, and in particular with reference to FIG. 5, the display module 16 includes tabs 20*a*, 20*b*, 20*c*, and 20*d*, which are located in channels 18*a*, 18*b*, 18*c*, and 18*d*, respectively. While only one tab along a single channel is labeled in the figures herein, it is contemplated that one or more tabs are located along each channel in order to secure the risers to the display module. For example, the tabs along a first channel, or channel 18*a*, may be referred to as a first set of tabs, while the tabs along a second channel may be referred to as a second set of tabs, such that the first set of tabs engage with the first hook profile that compresses, while the second set of tabs are engaging with the second hook profile. In one embodiment, the quantity of tabs across the length of each channel is selected to provide strength to the display module while utilizing thinner materials, as previously discussed.

In one embodiment, when a hook profile (items 14*a*-14*d*) is engaging with a channel (items 18*a*-18*d*), the tabs (items 20*a*-20*d*) force the hook profile to compress in order for the hook profile to be fully engaged with the channel. Once the hook profile of the riser is seated into the channel, the hook profile returns to its original position, or non-compressed position, thereby locking the riser into the display module. In yet another embodiment, instead of or in addition to the hook profile compressing during engagement with the tabs, the tabs may compress, and subsequently return to their original or non-compressed positions. As such, it is contemplated that one or both of the tabs of the display module and the hook profile of the riser compress during engagement. As used herein, engagement refers to both the contact of a hook profile with a channel, and the contact of a hook profile with the tabs.

Figure 2:
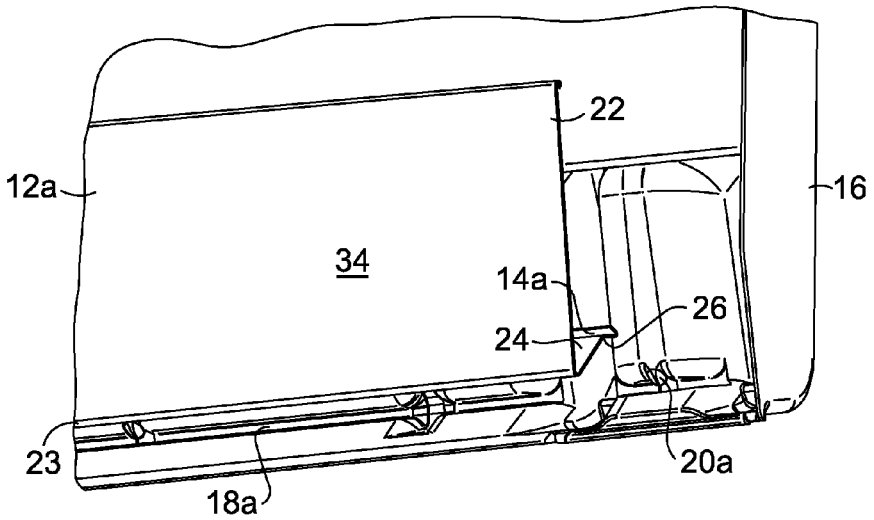

Turning now to FIG. 2, an enlarged fragmentary view of a portion of the snap-in card top riser of FIG. 1 is illustrated, in accordance with an embodiment of the present invention. Many of the same components of the snap-in card top riser 10 of FIG. 1 are illustrated here. For instance, one of the risers, riser 12*a*, is illustrated in an exploded view where it is not yet coupled with the display module. The riser 12*a* has an upper panel 22, having a first or lower edge 23, and a lower panel 24, having a first or distal edge 26. The upper panel 22 has a front surface 34 and a rear surface 36 (shown in FIG. 4). Generally, the front surface 34 of the upper panel 22 faces away from the display module 16. Further, the riser 12*a* includes a hook profile 14*a* that extends from the first edge 26 of the lower panel 24. Similarly, as illustrated in FIG. 2, the display module 16 has a generally horizontal lateral channel 18*a* into which the hook profile 14*a* is received. The display module 16 also includes a plurality of tabs, including tab 20*a*.

FIG. 3 is a perspective view of at least a portion of a snap-in card top riser, in an orientation to view it more from the right side, in accordance with an embodiment of the present invention. As mentioned, a snap-in card top riser may have any quantity of risers depending on, for instance, the quantity of greeting cards that the card top riser is to hold and how tall the card top riser is to stand from the ground. Here, one riser, riser 12*a*, is illustrated. However, a single riser is illustrated as just one example of the quantity of risers utilized in a card top riser, and it is contemplated that any other quantity of risers could also be utilized. In FIG. 3, the riser 12*a* includes an upper panel 22, having a first edge 23 and a front surface 34, and a lower panel 24, having a first edge 26, the lower panel 24 extending from the first edge 23 of the first surface 22. In the embodiment shown in FIG. 3, an angle formed between the upper panel 22 and the lower panel 24 is less than 90°, and as such is an acute angle, but in other embodiments, the angle may be equal to or greater than 90° (a right or obtuse angle). It should be noted that while the risers are described as having upper and lower or first and second panels that connect with each other along an edge in order to describe portions of the risers, the risers may be fashioned as a single unitary piece, such that the transition between the panels is merely a bend. The risers may be formed by an extruding process or a molding process.

The hook profile 14*a* extends from the first edge 26 of the lower panel 24 of the riser 12*a*. The hook profile 14*a* is shown in FIG. 3 as having been received into a channel of the display module 16. One tab, tab 20*a*, is illustrated here. As mentioned, while the hook profile 14*a* is engaging with the channel, the hook profile 14*a* may compress into a compressed position in order to fit past a lowermost protrusion of the tab 20*a* and into the channel. Alternatively, the tab 20*a* may compress but the hook profile 14*a* may not compress during engagement. Even further, both the tab 20*a* and the hook profile 14*a* may compress or deflect slightly during engagement of the hook profile 14*a* into the channel.

As shown in FIG. 3, the display module is labeled as 16*a*, which is a first portion of the display module 16 of FIG. 1. Additional portions of the display module may be utilized, but for the sake of clarity, just the first portion 16*a* of the display module is shown here. For example, the display module may also comprise a second portion, a third portion, a fourth portion, and so on. The second portion of the display module may be adjacent to or located above the first portion. Accordingly, the third portion may be adjacent to or located above the second portion, etc. The first portion 16*a* of the display module comprises an upper section 28, a middle section 30, and a lower section 32. The upper section 28 has a front surface 38, which faces the rear or back surface 36 of the upper panel 22 of the riser 12*a*. While in one embodiment the front surface 38 of the upper section 28 is substantially parallel to the back surface 36 of the upper panel 22, it is contemplated that other configurations may be utilized. However, not every portion of the display module has to include all three sections. The first portion 16*a* of the display module may have the lower section 32, while other portions of the display module may not. For instance, the first portion 16*a* of the display module is the bottommost portion. However, if more than one riser is utilized, the portion of the display module that corresponds to a second riser, for instance, may have only a first surface and a second surface. This can more clearly be seen in FIG. 5.

FIG. 4 is a perspective view taken more from a rear of the right side of a snap-in card top riser, in accordance with an embodiment of the present invention. This rear view illustrates the riser 12*a* with an upper panel 22 and a lower panel 24. The first or proximal edge 23 of the upper panel 22 is shown and the lower panel 24 extends rearwardly from the first edge 23 of the upper panel 22. The first or distal edge 26 of the lower panel 24 is also shown here. The hook profile 14*a* extends from the first edge 26 of the lower panel 24. The back surface 36 of the upper panel 22 is illustrated. A portion of the display module 16 is illustrated, which includes channels 18*a* and 18*b*, and tabs 20*a* and 20*b*. As illustrated, the channel 18*a* has not yet received the hook profile 14*a* of the riser 12*a*. Accordingly, a portion of the front side of the channel 18*a* is visible through an opening adjacent the tab 20*a*. In contrast, the riser 12*b* is already coupled with the display module 16 (see FIGS. 1 and 2), so the hook profile 14*b* is already received in the channel 18*b* and a portion thereof is visible in an opening adjacent the tab 20*b*. The display module 16 may be formed by a molding process and may include structural ribs 40. The ribs may have openings 42 therein to permit coupling the display module 16 to the metal frames or fixtures (not shown) that support the display modules.

Figure 5:
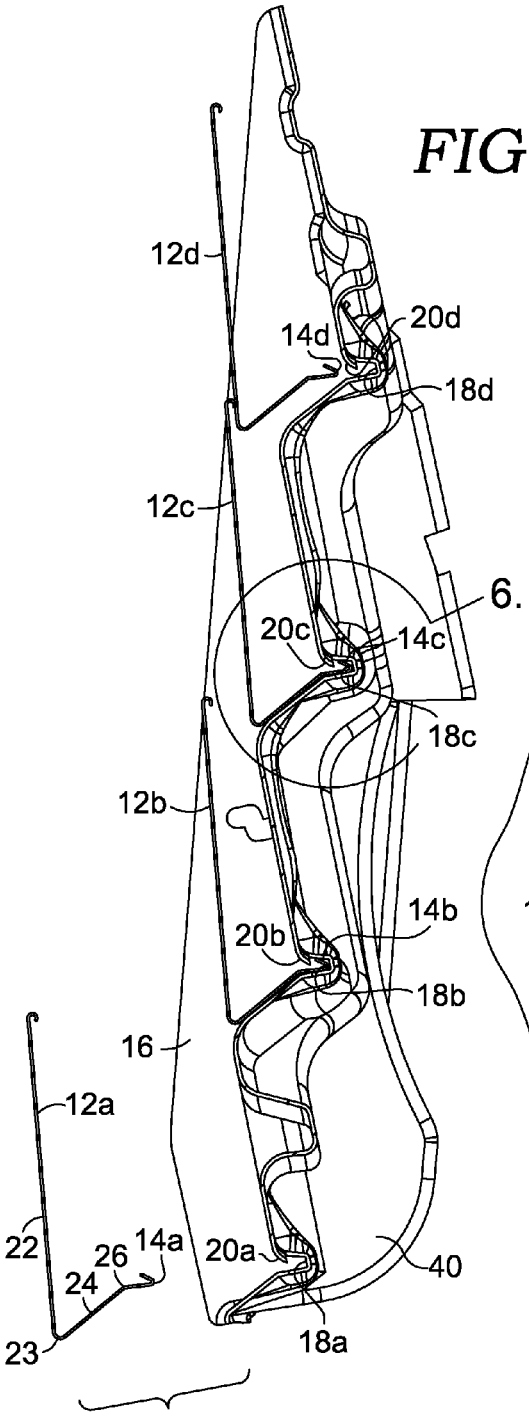

FIG. 5 is a right side elevation cross sectional view of the snap-in card top riser of FIG. 1 taken along the line 5-5, in accordance with an embodiment of the present invention. This figure illustrates riser 12*a* not yet engaged with the display module 16, riser 12*d* that is about to engage with the display module 16, and risers 12*b* and 12*c* that are fully engaged with the display module 16. Upon coupling riser 12*a* to the display module, the hook profile 14*a* will engage with the tab 20*a* and will be received into the channel 18*a*. This allows for the riser 12*a* to be secured to the display module 16. Risers 12*b* and 12*c* are illustrated as already being fully engaged with the display module 16, and thus the risers 12*b* and 12*c* are locked into position and as such should remain in that position relative to the display module 16 until the risers 12*b* and 12*c* are removed from the display module 16. The hook profiles 14*b* and 14*c* of the risers 12*b* and 12*c*, respectively, engage with the channels 18*b* and 18*c*, respectively, by first engaging with at least the tabs 20*b* and 20*c*, respectively. As such, during engagement, the tabs 20*b* and 20*c*, the hook profiles 14*b* and 14*c*, or both, would have compressed in order for the hook profiles 14*b* and 14*c* to fit into the channels 18*b* and 18*c*. As shown here, once the hook profiles 14*b* and 14*c* have been received into the channels 18*b* and 18*c*, respectively, the hook profiles 14*b* and 14*c* return to their original or uncompressed position.

The riser 12*d* is shown in FIG. 5 as not having yet been engaged with the display module 16. The hook profile 14*d* will make physical contact with the tab 20*d*, where one or more of the hook profile 14*d* or the tab 20*d* will be forced to compress, thus allowing the hook profile 14*d* to be received into the channel 18*d*. The compression may occur as a result of a manual force exerted on the riser 12*d* in the direction toward the display module 16 to force the hook profile 14*d* into the channel 18*d*. Once the riser 12*d* is received into the channel 18*d*, the card top riser is able to hold greeting cards or other items for display to consumers.

Figure 6:
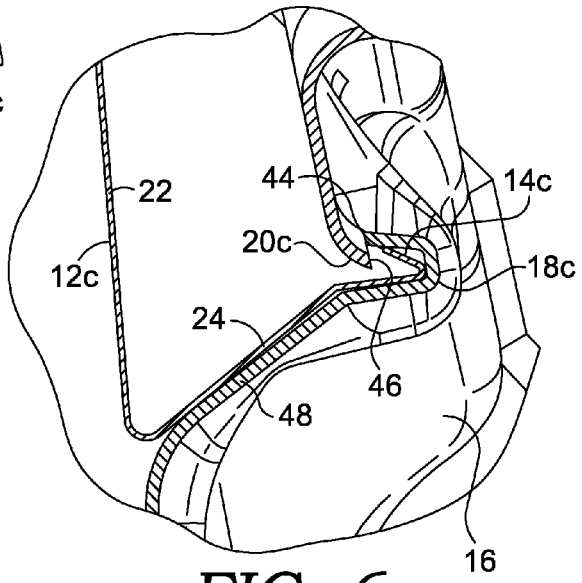

Turing to FIG. 6, an enlarged fragmentary view of a portion of the snap-in card top riser of FIG. 5 in the area 6 is depicted, in accordance with an embodiment of the present invention. The riser 12*c* has the hook profile 14*c* that has been received in the channel 18*c* of the display module 16. For instance, force may have been applied to the riser 12*c* against the display module 16 so that the tab 20*c*, the hook profile 14*c*, or both were compressed as the hook profile 14*c* was being received into the channel 18*c*. Once received, the riser 12*c* is secured to the display module 16. In one embodiment, when the riser 12*c* is secured to the display module 16, the riser 12*c* is locked or held into place, and remains in a substantially consistent position, or stationary, relative to the display module 16. For example, when the ends of the display module are in place, the riser 12*c* and other risers may be unable to move laterally, as they are constrained by the ends. In an alternative embodiment, however, the riser 12*c* and other risers discussed herein may be slidably engaged with the display module when the riser has been received into the channel. As such, in this embodiment, the riser is configured to slide longitudinally along the channel when the riser is secured to the display module. This alternative embodiment may occur if the ends of the display module are removable and are removed for removal of the risers. In another embodiment, the channels may include vertical ribs therein and the hook profiles of the risers may include corresponding cutouts so the cutouts are received around the ribs and the ribs prevent lateral movement of the riser.

As best seen in FIG. 6, the hook profile is preferably a portion of the distal or first edge 26 of the lower panel 24 that is turned back toward the upper panel 22, such that an outer edge 44 of the riser engages a rear facing portion 46 of the tab 20 when the hook portion 14 is received in the channel. The bend that forms the turned back portion provides a natural spring-like resilience to the hook portion 14 that permits the turned back portion to be deflected downwardly when it is pressed pass and engages with the tab 20 and bounce back to the rest position illustrated in FIG. 6 when the outer edge 44 moves past the tab 20 and is fully received in the channel 18.

As also best seen in FIG. 6, a shelf portion 48 of the display module 16 helps support the riser when it is coupled with the display module 16. In use, when the hook portion is received in the channel, the lower panel 24 of the riser 12 rests on the shelf portion 48 of the display module 16 and downward forces on the riser (from cards received therein or users pulling downwardly or forwardly on the riser to get cards out) are transferred to the display module. When the upper panel 22 is rotated forwardly, the shelf portion supports the weight and the turned back portion of the hook portion 14 engages an upper wall of the channel 18.

In one embodiment, the risers and the display module are vacuum formed, and thus may be constructed from plastic that is heated to a forming temperature, and stretched or flowed onto or into a mold. The plastic is forced against the mold by a vacuum. The particular type of plastic used may be dependent upon the process used, but may include, for example, thermoplastics, such as high impact polystyrene sheeting (HIPS). In embodiments, the vacuum forming allows the material used to be thinner, thus reducing overall costs of the card display modules. Risers made using this design may not require secondary trimming, while the molds used to produce the vacuum formed display modules may not require moving sections or flipper mechanisms. Other types of plastic are contemplated to be within the scope of embodiments of the present invention. Further, one or both of the riser or the display module may be constructed from some other material, including metal, wood, or the like. These materials are applicable to the construction of the modular tower, including the components thereof, as well.

Figure 7:
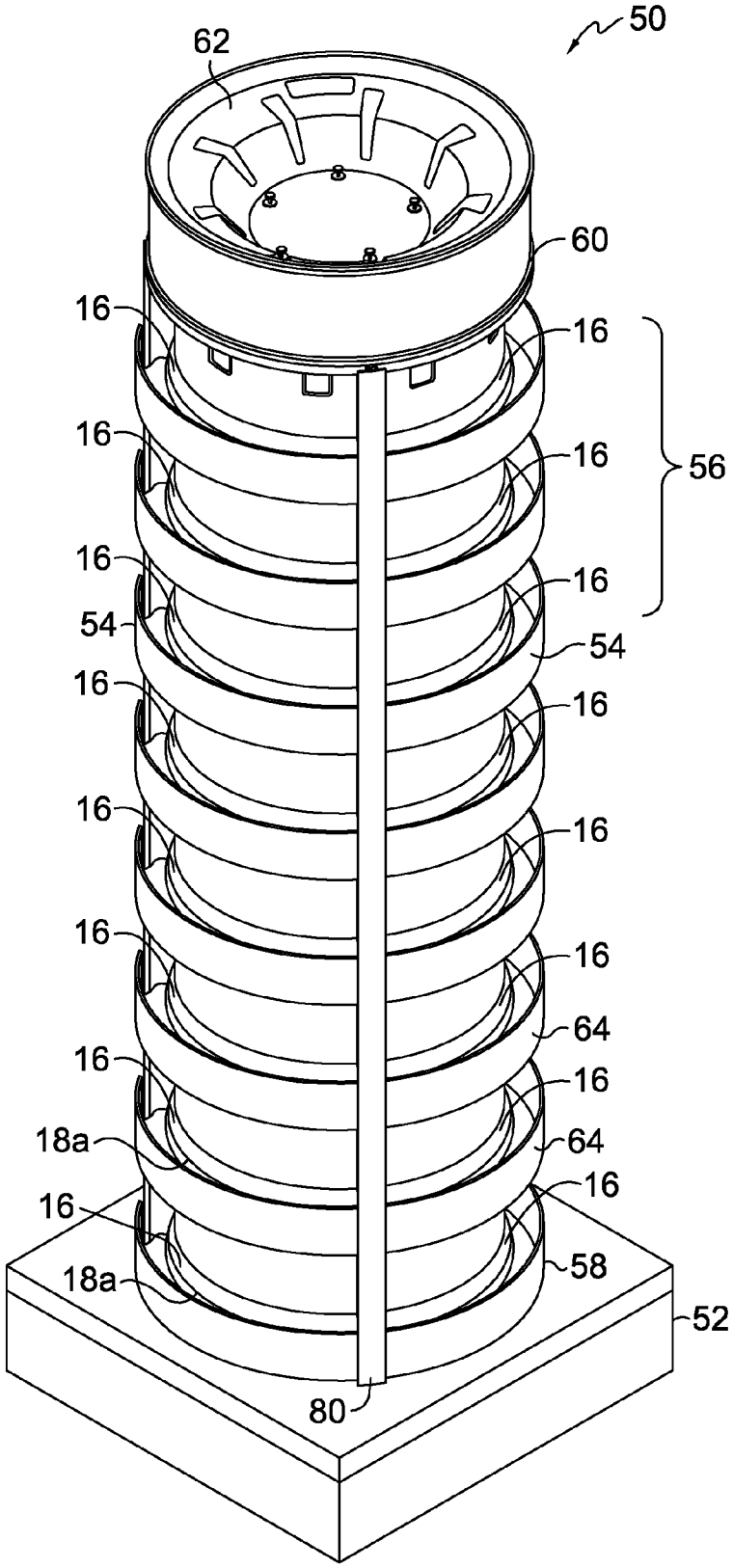

Turning to FIG. 7, a perspective view of a modular display tower 50 on a base 52 is depicted, in accordance with an embodiment of the present invention. The base 52 supports, multiple vertical display portions 54 which extend upward from the base 52. Each display portion 54 may be an individual vac-formed panel or multiple pieces joined together. Although not depicted explicitly in FIG. 7, the base 52 may be a rotating spinner-type base, or a fixed base that does not allow the vertical display portions 54 to rotate. Each of the vertical display portions 54 visible in FIG. 7 (two are visible; one is obscured on the backside of the tower 50) is a curved-type vertical display portion 54 having a plurality of display modules 16. The display modules 16 may include the features and aspects of the embodiments of the display modules 16 described above. Accordingly, each display module 16 includes one or more channels 18*a* for receiving one or more risers, such as the risers 12*a*-12*d*, described herein. The display modules 16 are organized in a stacked configuration 56 between a bottom 58 and a top 60 of a respective vertical display portion 54. Additionally, a top cover 62 is depicted positioned on the top of the vertical display portions 54 to provide additional support for the display portions 54.

An outer covering 64, which may be transparent, translucent, or at least partially see-through in certain embodiments, is coupled to the outside of each of the display modules 16. The outer coverings 64 are akin to the risers 12*a*-12*d* above and are described in more detail below as risers 90. The outer covering 64 at least partially covers the display modules 16 to help retain and protect display items attached or positioned in the display modules 16, and provide a clean, consistent look to the display tower 50.

Each of the display portions 54 in FIG. 7 is coupled to an adjacent vertical display portion 54 at respective side edges with a bridge coupling 80. The bridge coupling 80 is a strip that is positioned along a length of each of the adjacent side edges, allowing the display portions 54 to be joined together to provide a circumferential construction of the vertical display portions 54.

Figure 8:
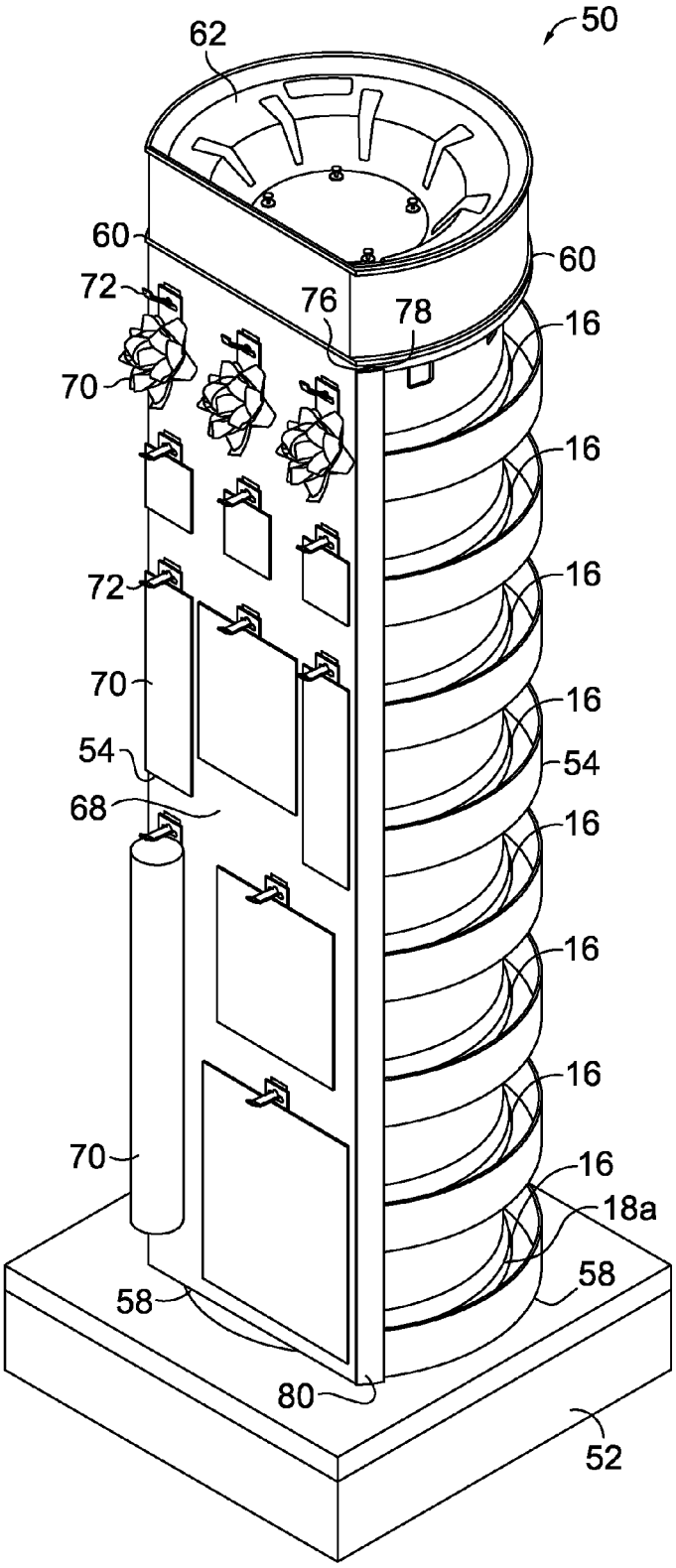

FIG. 8 is a perspective view of a modular display tower 50 with an alternate configuration, in accordance with an embodiment of the present invention. In FIG. 8, like FIG. 7, three vertical display portions 54 are coupled together to form the general barrel or circumferential shape of the display tower 50. In FIG. 8, however, one of the three vertical and curved display portions 54 of FIG. 7 has been replaced with a flat display 68. The flat display 68 is used for presenting hanging merchandise 70. The flat display 68 includes a plurality of hooks 72 for receiving and supporting the hanging merchandise 70. Once again, the vertical display portions 54, including the flat display portion 68, extend from the base 52 and are joined together at side edges 76, 78 of each of the respective display portions 54. By having removable, interchangeable display portions 54 of varied construction (e.g., flat, curved, a peg-board with hooks, etc.), different configurations of the tower 50 are possible, to allow versatility for presenting different types of display items. Additionally, the construction of the tower 50, with display portions 54 joined at side edges 76, 78, provides structural integrity without using a heavy or material intensive center structure, such as a support post or solid frame. The assembled construction also allows for simplified breakdown, reconfiguration, and storage of the display tower 50.

Figure 9:
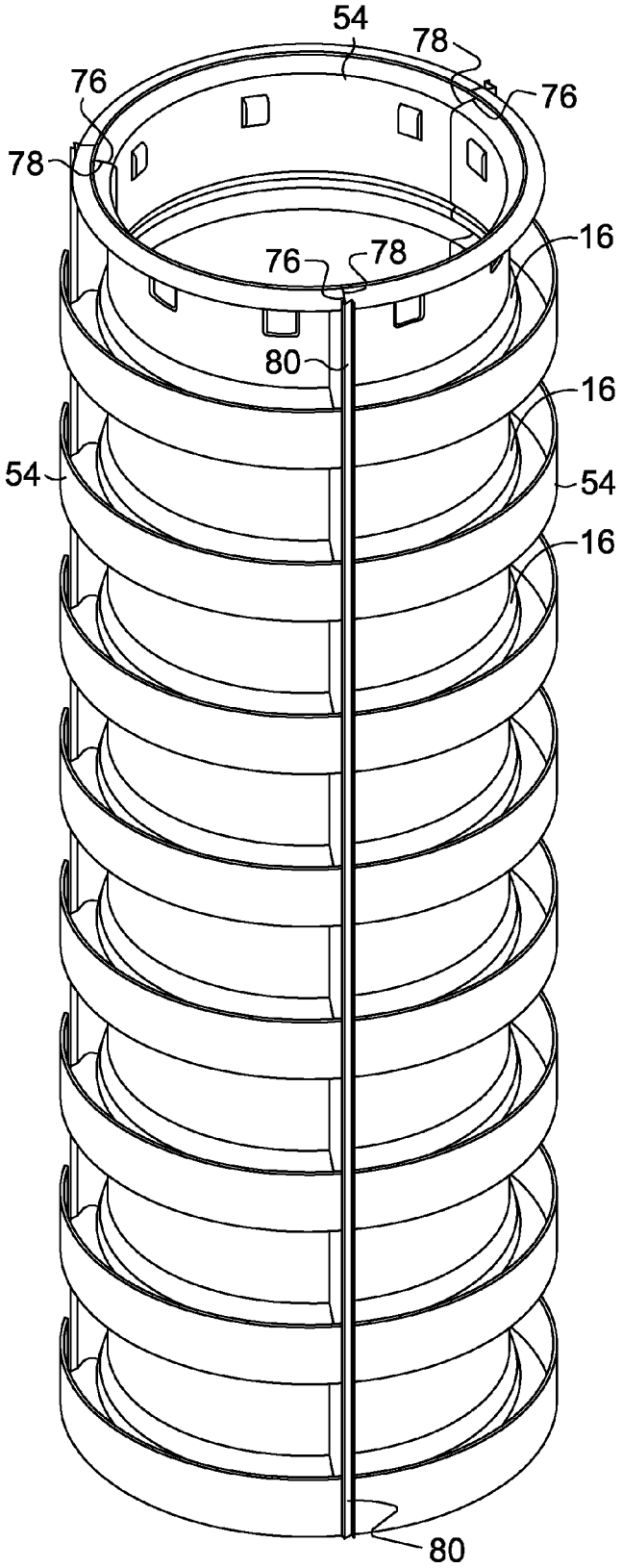

FIG. 9 is a perspective view of three yet to be assembled vertical display portions 54 for use with a modular display tower 50, in accordance with an embodiment of the present invention. In FIG. 9, each of the three vertical display portions 54 is positioned adjacent each other to align adjacent side edges 76, 78 for assembly. In this regard, the side edges 76, 78 of each vertical display portion 54 comprise a first side edge 76 and a second side edge 78. In different embodiments, different size and shape display modules 16 may be used for display items of different sizes, or provide risers of differing types and sizes. Additionally, adjacent vertical display portions 54 depicted in FIG. 9 are joined with a bridge coupling 80 that removably couples the first and second edges 76, 78 of the adjacent vertical display portions 54. The display portions 54, depicted in FIG. 9, include risers 90 formed into shape and coupled with display modules 16 and ready for use supporting and displaying items, such as greeting cards.

Figure 10:
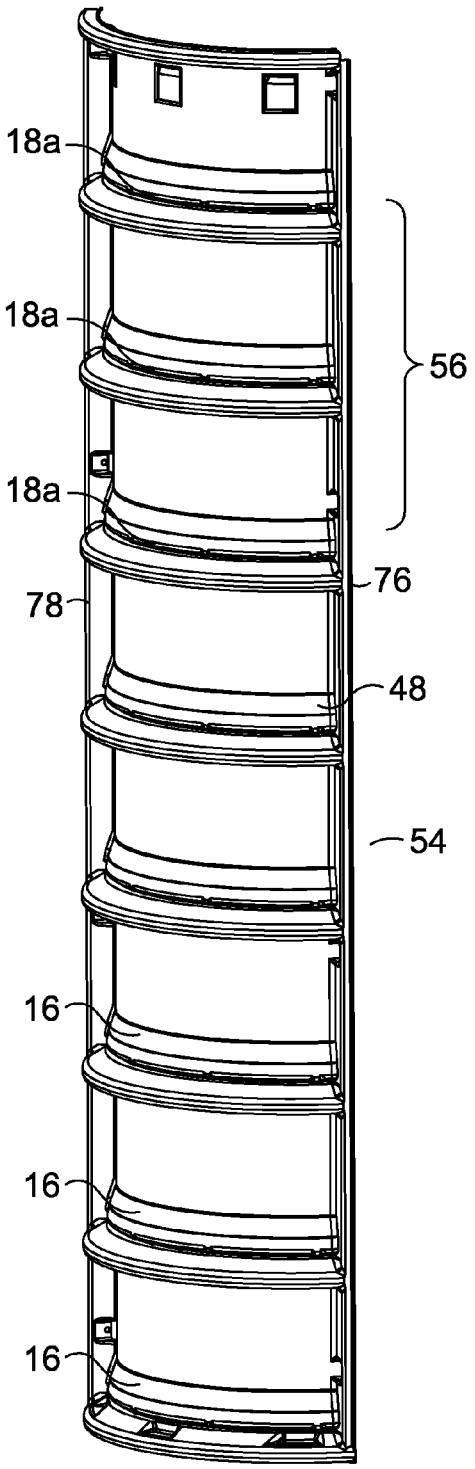

FIG. 10 is a perspective view of one possible embodiment of a vertical display portion 54 in accordance with the present invention. In FIG. 10, the display portion 54 includes the plurality of display modules 16 arranged in a stacked configuration 56 without any outer coverings 64 or risers 90. Each display module 16 includes a shelf portion 48 and a channel 18*a* for receiving one or more risers 90. Each display portion 54 includes the first and the second edges 76, 78. Each display portion 54 may be formed as a single unitary structure (e.g., by a vac-forming process) or may simply be a stacked arrangement 56 of individual, separate display modules 16, where the edges of the display modules 16 form the first and the second side edges 76, 78 of the corresponding vertical display portion 54.

Figure 11:
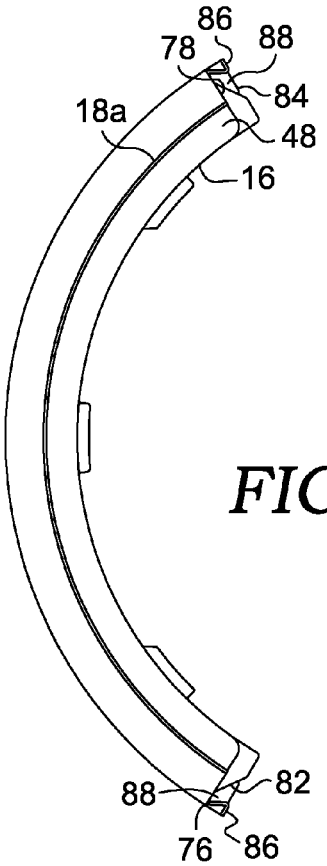

FIG. 11 is a top plan view of the vertical display portion 54 of FIG. 10 and illustrates a single display module 16. The display module 16 has a shelf portion 48 and a channel 18*a*. Additionally, the first side edge 76 is depicted having a first mateable coupling component 82 and the second side edge 78 is depicted having a second mateable coupling component 84, where each of the mateable coupling components 82, 84 is configured to be joined together with a bridge coupling, such as the bridge coupling 80 shown in FIG. 7, 17, and/or 18. In alternate embodiments, the side edges 76, 78, or mateable coupling components 82, 84 thereof, may be configured to be joined or removably secured directly to each other, without the necessity of an intermediate bridge-coupling 80 or other joining component. The bridge-coupling component 80 allows a simplified construction process, and covers the joined edges 76, 78 of the display portions 54 with a strip-like covering, providing a more seamless look to the modular tower 50, as well as structural rigidity. In the embodiment shown in FIG. 11, the mateable coupling components 82, 84 each include a tab 86 and an opening 88 for engagement with the bridge coupling 80.

Figure 12:
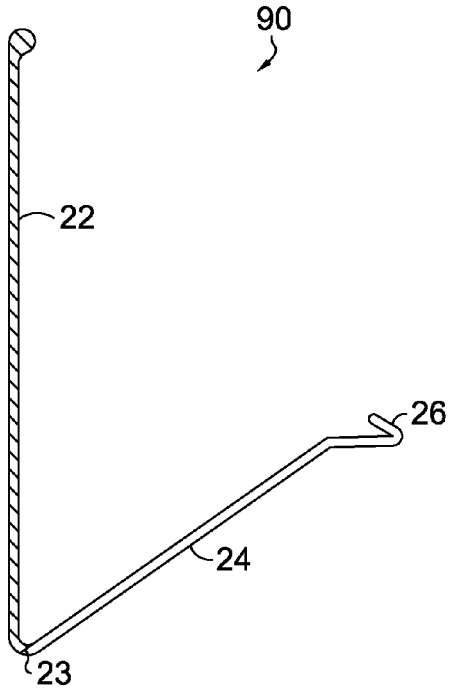

FIGS. 12-16B depict an exemplary riser 90 in both a rest or straight shape and a use or curved shape for use with a display module 16 of the modular display tower 50. FIG. 12 is a side elevation, cross-sectional view of the riser 90, in accordance with an embodiment of the present invention. In FIG. 12, the riser 90 includes an upper panel 22 and a lower panel 24, the lower panel 22 extending form a first edge 23 of the upper panel 22 and having a hook profile with a distal edge 26 that can be received in a channel 18*a* of a display module 16 (as discussed above with reference to risers 12*a*-12*d*) incorporated into the modular tower 50.

Figure 13:
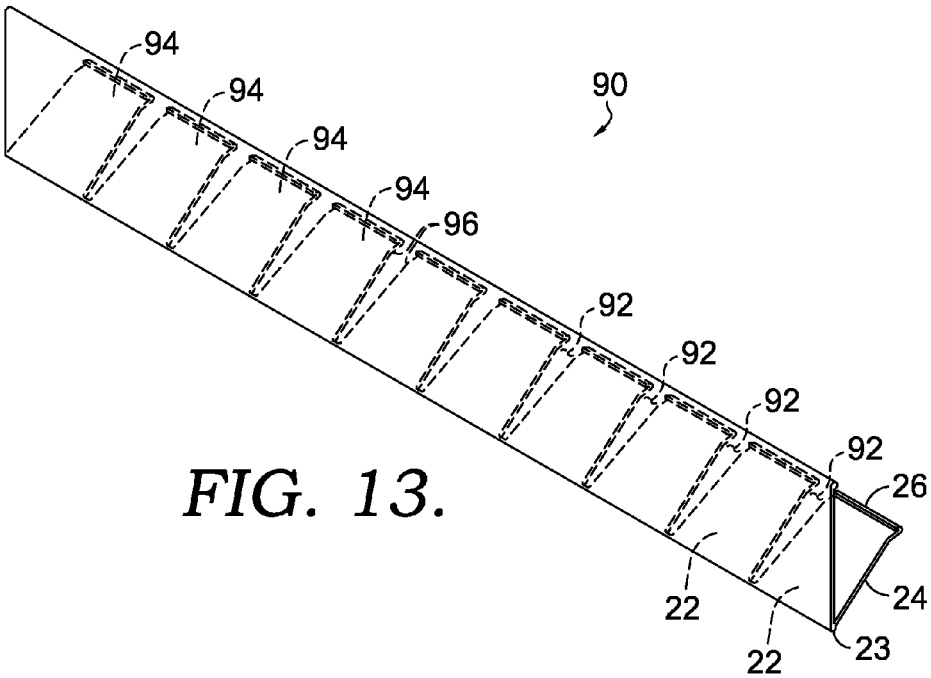
Figure 15:
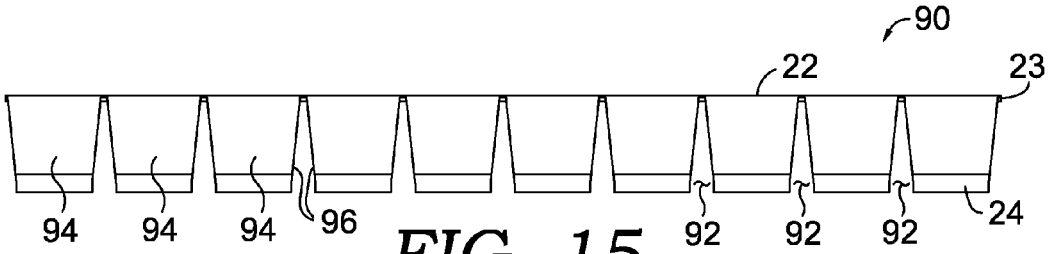
Figure 16A:
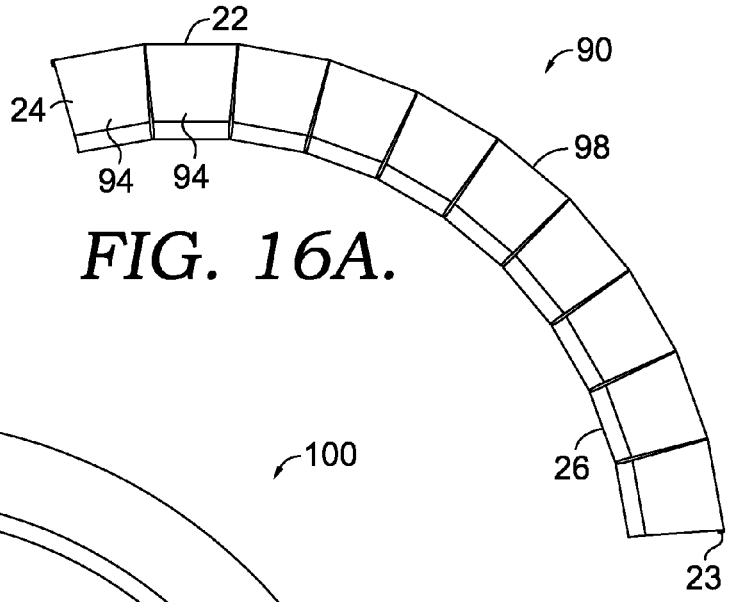
FIG. 16A is a bottom plan view of the riser of FIG. 15 bent into a curved shape for coupling with a vertical display portion for use, in accordance with an embodiment of the present invention.

FIG. 13 is a top perspective view of the riser 90 in its pre-bent configuration and showing cut-out sections 92, in accordance with an embodiment of the present invention. The riser 90 depicted in FIG. 13 includes the upper panel 22 and the lower panel 24, where the lower panel 24 includes the cut-out sections 92 that segment the lower panel 24 into a plurality of lower panel sections 94 that permit curving of the upper panel 22 to form a curved riser 90 until edges 96 of the lower panel sections 94 abut each other, as depicted in FIG. 16A. Stated differently, by cutting sections out of the lower panel 24 of a straight riser, the lower panel 24 can be folded inward along the plane of the lower panel 24, closing the gaps formed by the cut-out sections 92, and providing a curved shape of the riser 90 along the upper panel 22 and the lower panel 24 (shown in FIG. 16A). This provides allows for the manufacture of a straight riser (FIGS. 12-15) that may be formed into a curved riser (FIGS. 16A-16B) for use with the display modules 16 in the modular tower 50.

Figure 14:
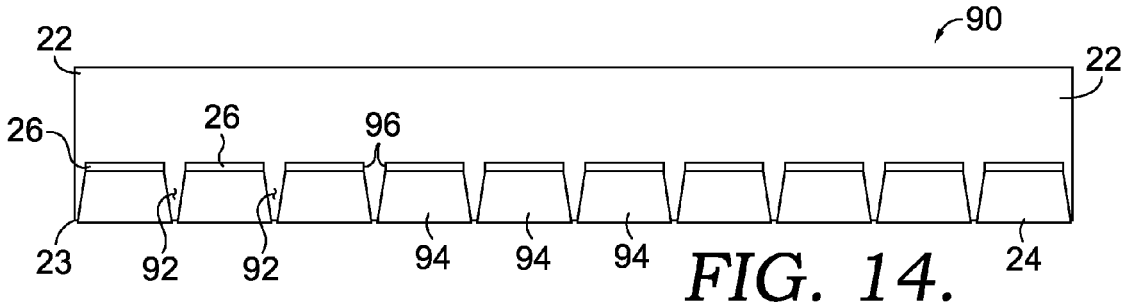

FIG. 14 depicts the rear elevation view of the riser 90 of FIG. 13, in accordance with an embodiment of the present invention. In FIG. 14, the angle of the upper panel 22 relative to the lower panel 24 is depicted. The cut-out portions 92 of the lower panel 24 are also depicted prior to the upper panel 22 being bent into the curved shape (shown in FIG. 16A). FIG. 15 is a bottom plan view of the riser 90 of FIG. 13 showing similar features of the riser 90, in accordance with an embodiment of the present invention.

Figure 16B:
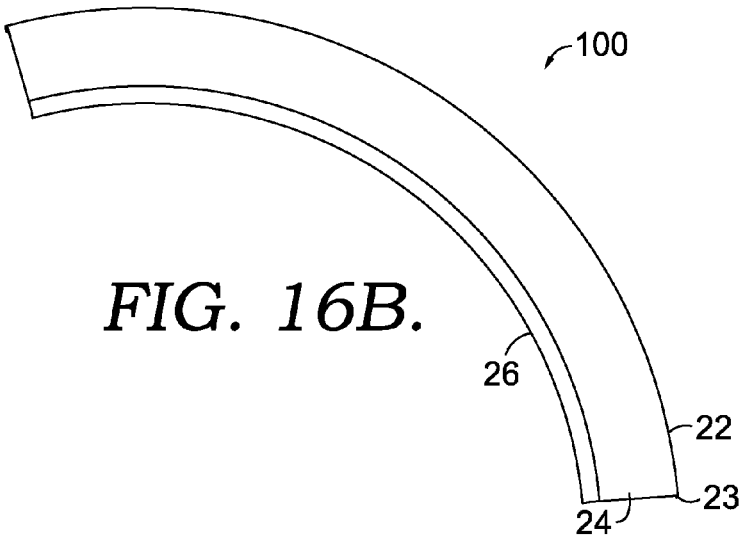
FIG. 16B is a top plan view of the curved riser of FIG. 16A.

FIG. 16A is a bottom plan view of the riser 90 of FIG. 13 bent into the curved shape 98, in accordance with an embodiment of the present invention. In FIG. 16A, gaps in the lower panel formed by the cut-out sections 92 are eliminated as edges 96 of the lower panel sections 94 are brought together, and the plurality of lower panel sections 94 are moved inward along the plane of the lower panel 24, closing the gaps and bending the straight riser 90 into a curved shape 98 that can be received in a channel 18*a*, which may be a curved channel corresponding to the curved shape 98 of the riser 90, of a display module 16 used in the display tower 50. FIG. 16B is a top plan view of the curved riser 90.

Alternatively, a curved riser 100 may be formed directly, rather than from a modified straight piece, in accordance with an embodiment of the present invention, and would have the same appearance as depicted in FIG. 16B. The single piece may be injection molded or extruded PVC, PETG (Polyethylene terephthalate), plastic, or another polymer, and otherwise shaped such that it does not require secondary modification to achieve the curved profile.

Figure 17:
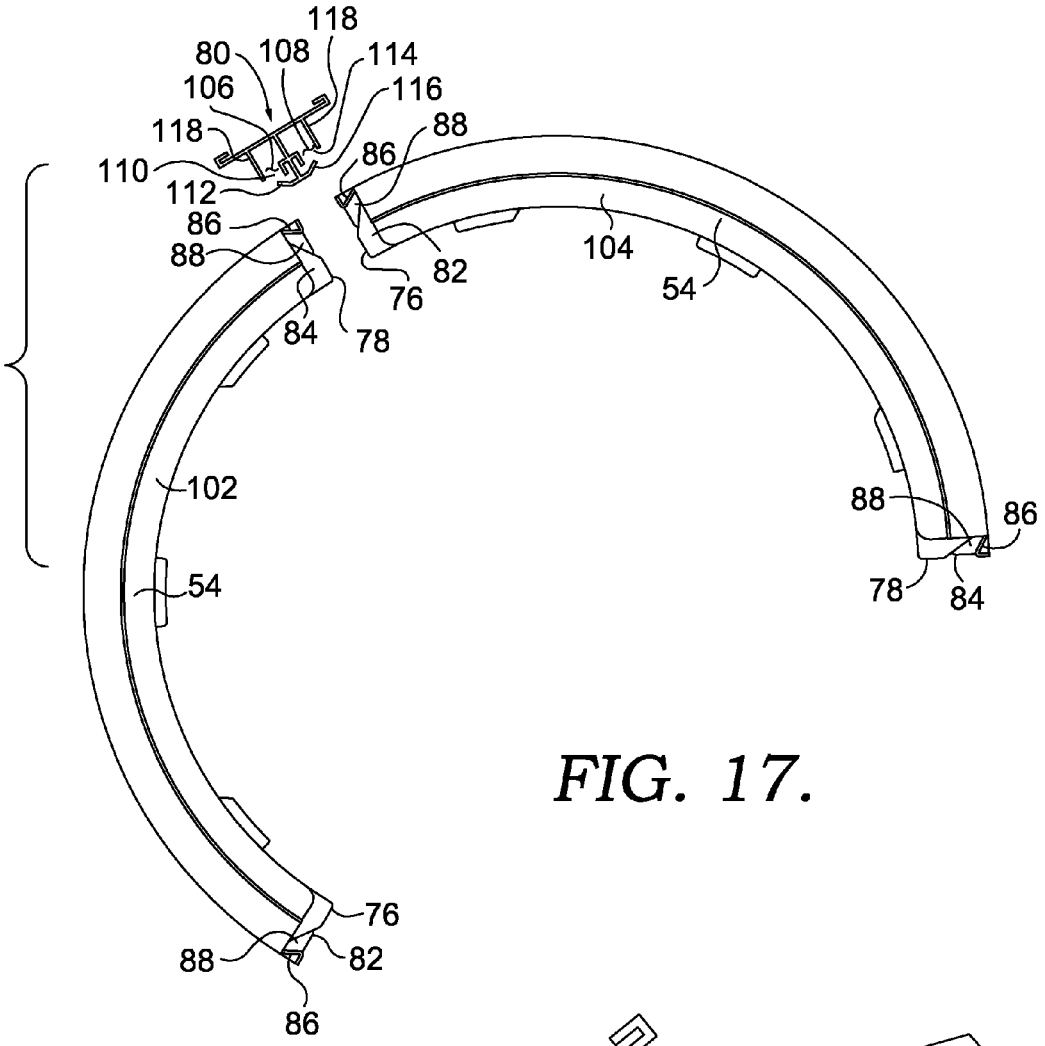
Figure 18:
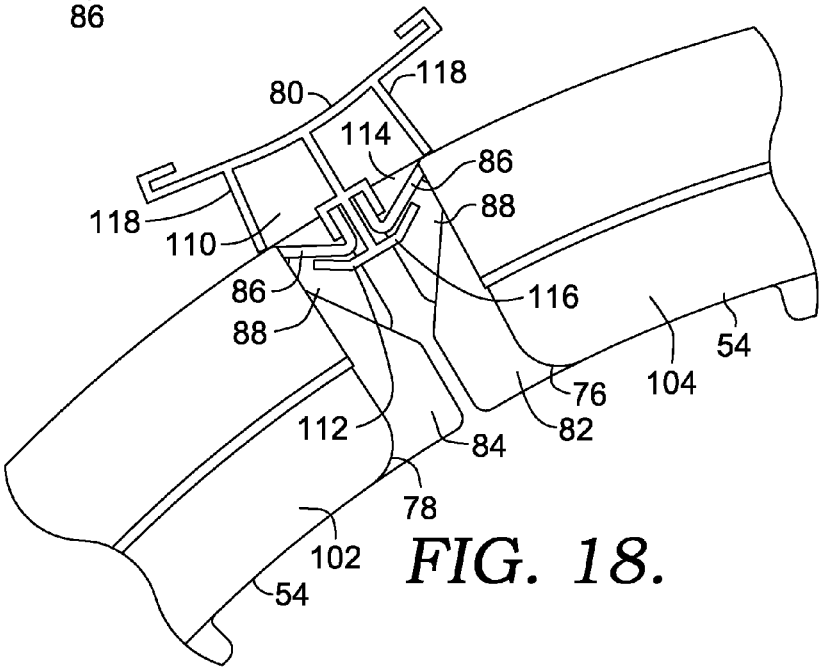

FIG. 17 is a top plan view of two vertical display portions 102, 104 ready to be joined together with a bridge-coupling 80, in accordance with an embodiment of the present invention. In FIG. 17, a first vertical display portion 102, or rather a top display module thereof, having a first edge 76 with a first mateable coupling component 82 and a second edge 78 with a second mateable coupling component 84 is provided. Additionally, a second vertical display portion 104, or rather, a top display module thereof, having a first edge 76 with a first mateable coupling component 82 and a second edge 78 with a second mateable coupling component 84 is provided. The second mateable coupling component 84 of the second edge 78 of the first vertical display portion 102 is positioned proximate the first mateable coupling component 82 of the first edge 76 of the second vertical display portion 104. Each of the first and the second mateable coupling components 82, 84 on the first and the second vertical display portions 102, 104 include a respective tab 86 and opening 88. The bridge-coupling 80 includes a third mateable coupling component 106 having an opening 110 and a tab 112, and a fourth mateable coupling component 108 having an opening 114 and a tab 116. The third and fourth mateable coupling components 106, 108 also include outer hooks 118 that are elastically deformable such that they can deflect when the bridge coupling 80 is engaged with the first and the second mateable coupling components 82, 84 of the vertical display portions 102, 104, as illustrated in FIG. 18. The hooks 118 provide tension against the display portions 102, 104 when the bridge coupling component 80, which may be a strip that extends the length of the vertical display portions 102, 104, is engaged. In this regard, hooks 118 may bend to provide a tighter or friction-fit connection. While bridge coupling 80 flexes during use in the illustrated embodiment, it is within the scope of the invention that the display portions 102, 104 alone or in combination with the bridge coupling 80 may provide deflection. Similarly, while it has been depicted that the hooks 118 and or a face of bridge coupling 80 flex upon assembly, the may come all or partially from flexing of the tabs 86. The bridge couplings 80 may be extruded from metal or PVC, PETG (Polyethylene terephthalate), plastic, or another polymer. The bridge couplings 80 may be extruded elongate members having channels formed therein to provide the third and fourth mateable coupling components 106, 108.

FIG. 18 is an enlarged, fragmentary top plan view of the bridge coupling 80 and display portions 102, 104 of FIG. 17 after being joined together, in accordance with an embodiment of the present invention. As shown in FIG. 18, when the bridge-coupling component 80 is used to join the first and the second display portions 102, 104 together, the tab 86 of the second mateable coupling component 84 of the first vertical display portion 102 wraps around and engages the tab 112 of the third mateable coupling component 106 of the bridge coupling 80, and each of the tabs 86, 112 is at least partially received in the respective opening 88, 110 of the first mateable coupling component 82 and the third mateable coupling component 106. Additionally, the tab 86 of the first mateable coupling component 82 of the second vertical display portion 104 wraps around and engages the tab 116 of the fourth mateable coupling component 108 of the bridge coupling 80, and each of the tabs 86, 116 is at least partially received in the respective openings 88, 114 of the respective first mateable coupling component 82 of the second vertical display portion 104 and the fourth mateable coupling component 108. As shown in FIG. 18, when the bridge coupling component 80 is engaged, the hooks 118 bend to provide tension against the respective first and second vertical display portions 102, 104. The bridge coupling 80 may be formed to include opposed inwardly facing slots on an outer surface thereof to provide a display area for receiving signage, which may be in the form of long strips of cardstock with printing thereon.

Embodiments of the modular tower provide sufficient support such that a center post or other fixed structure may not be required to support the tower, due to the coupled and self-supporting nature of the circumferential vertical display portions. Additionally, secondary trimming processes may be used to allow the height of the vertical display portions to be adjusted to maximize display space for display items, such as for certain sizes of greeting cards. The flat display (illustrated in FIG. 8), which may be simple pegboard, may be used to display hanging display items as well as products sitting in trays, when desired. Although three vertical display portions are depicted in many of the drawings, in embodiments, any desired number of vertical display portions may be included and joined to provide a circumferential display. Additionally, the modular "shell" of the tower may be trimmed, such as with secondary trimming, and molded or joined together as desired, to form a desired shape profile. The tower may be formed or molded from PVC, PETG, or another polymer or plastic.

The design of the risers and display modules may be curved to form a "barrel" shape of the vertical display portions (e.g., of the shell). The vertical display portions may include a molded seam on each side, which may be a portion of the mateable coupling components. The seam may be configured to allow for quick assembly with a locking extrusion, which may comprise the bridge coupling. Multiple display towers, and/or their associated bases or spinning bases, may be joined or coupled together to form a larger display consisting of multiple towers.

Many variations can be made to the illustrated embodiment of the present invention without departing from the scope of the present invention. Such modifications are within the scope of the present invention. For example, while the risers have been illustrated as having the hook profile run the entire width of the riser, the hook profile may be used in multiple sections and not in other sections.

From the foregoing it will be seen that this invention is one well adapted to attain all ends and objects hereinabove set forth together with the other advantages which are clear following the complete disclosure above and which are inherent to the methods and apparatuses described herein. It will be understood that certain features and subcombinations are of utility and may be employed without reference to other features and subcombinations. This is contemplated by and is within the scope of the invention and claims.

Since many possible embodiments may be made of the invention without departing from the scope thereof, it is to be understood that all matter herein set forth or shown in the accompanying drawings is to be interpreted as illustrative of applications of the principles of this invention, and not in a limiting sense.

The invention claimed is:

1. A display tower, the tower comprising:

a base; and a plurality of vertical display portions coupled together, the plurality of vertical display portions supported on and extending upwardly from the base with at least one of the plurality of vertical display portions comprising:

a curved display portion having one or more curved display modules, the one or more curved display modules each having a curved channel formed therein, the curved channel extending laterally between first and second side edges of the curved display portion, and the curved channel adapted for receiving one or more curved risers;

wherein the plurality of vertical display portions further comprises at least one flat display portion.

2. The tower of claim 1, wherein the first side edge includes a first mateable coupling component and the second side edge includes a second mateable coupling component.

3. The tower of claim 2, further comprising an additional curved display portion and a bridge coupling configured to join the curved display portion with the additional curved display portion by attaching to the first or second mateable coupling component and also to a mateable coupling component positioned on a side edge of the additional curved display portion.

4. The tower of claim 1, wherein the one or more curved display modules comprises a plurality of curved display modules in a stacked configuration between a bottom and a top of the curved display portion.

5. The tower of claim 1, wherein each of the one or more curved display modules includes a curved riser coupled thereto.

6. The tower of claim 1, wherein the flat display portion comprises a flat pegboard with a plurality of hooks.

7. The tower of claim 1, wherein the tower includes a top cover coupled to top edges of each of the plurality of vertical display portions.

8. A display tower, the tower comprising:

a base; and two or more vertical display portions extending upwardly from the base and coupled together, each one of the two or more vertical display portions being flat or curved, at least one of the two or more vertical display portions comprising:

a curved display portion having one or more curved display modules, the one or more curved display modules each having a channel formed therein that is adapted for receiving a curved riser, and the channel extending laterally between first and second side edges of the curved display portion, wherein each of the one or more curved display modules includes at least one curved riser coupled thereto, and wherein each of the one or more curved display modules includes an outer covering configured to cover at least a portion of the at least one curved riser coupled thereto.

9. The tower of claim 8, wherein the one or more curved display modules comprises a plurality of curved display modules in a stacked configuration.

10. The tower of claim 8, wherein the two or more vertical display portions comprises three curved vertical display portions, wherein a first side edge of each of the three curved vertical display portions is coupled to a second side edge of an adjacent one of the three curved vertical display portions to form a display tower having a rounded outer circumference.

11. The tower of claim 8, wherein each of the one or more curved display modules includes a respective single curved riser coupled to the channel thereof.

12. The tower of claim 11, wherein the single curved riser comprises an upper panel coupled to a lower panel, the lower panel extending from a first edge of the upper panel, the lower panel having a hook profile and a distal edge that can be received in the channel.

13. The tower of claim 12, wherein the lower panel includes cut-out sections that segment the lower panel into a plurality of lower panel sections, and wherein the lower panel sections are moved into abutting contact at edges of the lower panel sections to provide a riser having a curved upper panel and a curved lower panel.

14. A method of constructing a modular display tower, the method comprising:

providing a base;

coupling two or more vertical display portions to the base, the two or more vertical display portions extending vertically upward from the base, at least one of the two or more vertical display portions comprising a flat display portion, and at least one of the two or more vertical display portions comprising:

a curved display portion having one or more curved display modules, the one or more curved display modules each having a channel formed therein, the channel extending laterally between first and second side edges of the curved display portion, and the channel adapted for receiving one or more curved risers;

releasably coupling together the two or more vertical display portions; and coupling one or more curved risers to the channel of each of the one or more curved display modules.

15. The method of claim 14, wherein each of the one or more curved display modules further comprises a respective outer covering that covers at least a portion of a curved riser received by the respective display module in the channel, and wherein the outer covering is at least partially see-through.

* * * * *